United States Patent [19]

Springall

[11] Patent Number: 5,060,590

[45] Date of Patent: Oct. 29, 1991

[54] SAILING APPARATUS

[76] Inventor: Oliver M. Springall, 458 Hobart Rd., New Brunswick, N.J. 08903

[21] Appl. No.: 505,683

[22] Filed: Apr. 6, 1990

[51] Int. Cl.[5] ..... B63B 15/00

[52] U.S. Cl. ..... 114/91; 114/39.2; 114/93

[58] Field of Search ..... 114/39.1, 39.2, 90, 114/91, 93, 98

[56] References Cited

U.S. PATENT DOCUMENTS

| | | | |
|---|---|---|---|
| 3,487,800 | 1/1970 | Schweitzer et al. | 114/91 |
| 4,311,107 | 1/1982 | Imre | 114/91 |
| 4,437,424 | 3/1984 | Lord | 114/91 |

FOREIGN PATENT DOCUMENTS

| | | | |
|---|---|---|---|
| 3013411 | 10/1981 | Fed. Rep. of Germany | 114/39.2 |

*Primary Examiner*—Jesû050609221 Sotelo

[57] ABSTRACT

A wind propelled apparatus in which a mast is mounted on a craft and supports an arcuate boom and a sail therebetween. The position of the mast and sail is controllable and maintained directly by the user and the movement of the mast during use, is confined by pivotal mast support mounted directly to the surface of the craft to only two degrees of freedom, rotation of the mast about its axis and pivotally in a plane perpendicular to the plane of rotation.

7 Claims, 2 Drawing Sheets

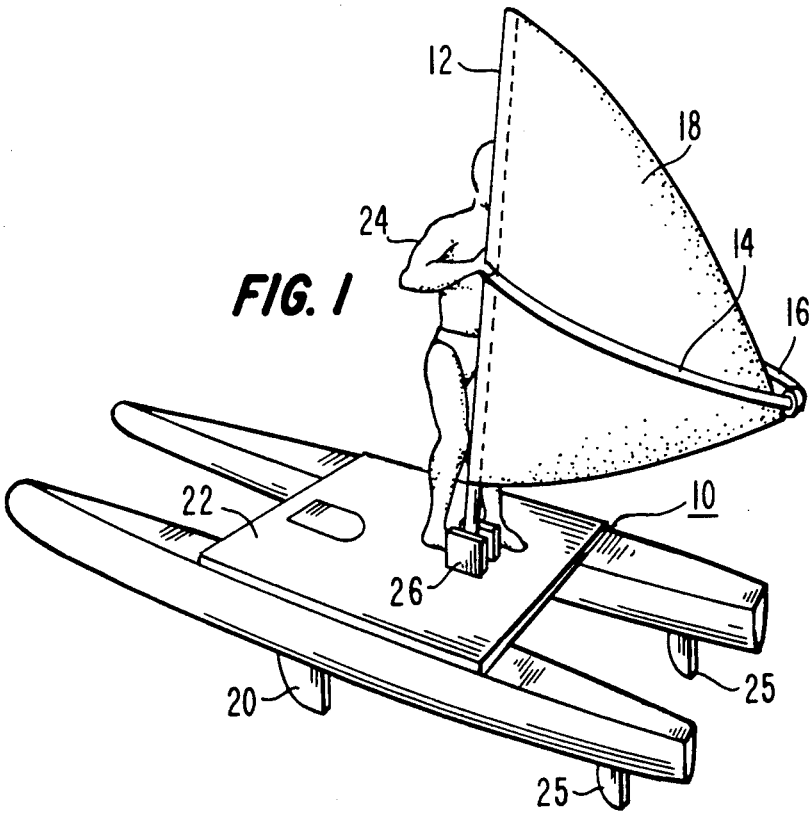
FIG. 1
FIG. 2
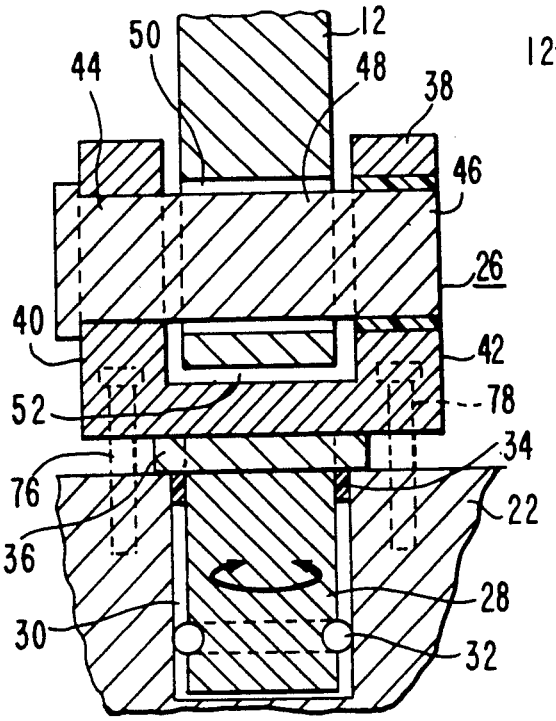
FIG. 3
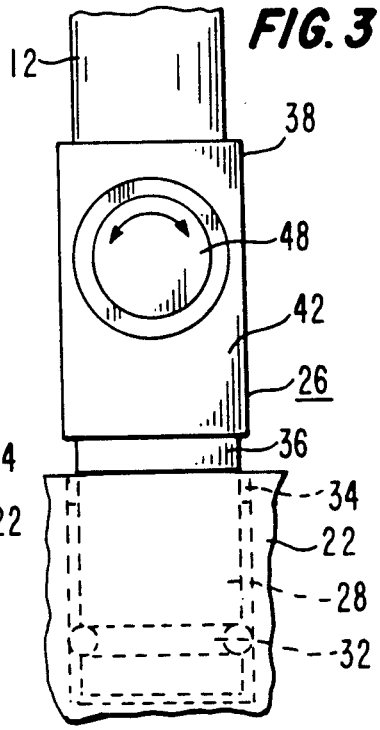

SAILING APPARATUS

BACKGROUND OF THE INVENTION

1. Field of the Invention

This invention relates to wind propelled vehicles such as sailboats, sailboards, iceboats and land vehicles having a sail supported by a mast and particularly to wide base or hull vehicles wherein the position of the sail is directly controllable by the user of such vehicle through movement of an arcuate boom on such mast.

2. Description of the Prior Art

In addition, to the traditional use of sail propulsion in large as well as small sail boats, sail propulsion has also been used in many other forms including for example, iceboats and surfboards and for land craft such as skateboards and sleds as well as other lightweight small craft. Typically, a sail is provided on a mast that is rigidly secured to the craft in a vertical position, or else the sail and mast are entwined in a network of riggings and control mechanisms.

More recently, wind propulsion vehicles of the type described in U.S. Pat. No. 3,487,800 issued to H. Schweitzer have gained popularity. The Schweitzer type vehicles add a certain dimension of wind responsiveness and speed to small sail craft and changes the vehicles normal ride and control characteristics by providing a vehicle body, such as a surfboard, and a mast which is universally mounted so as to be moveable in any direction (i.e. it has three degrees of freedom). The mast supports a pair of arcuately connected curved boom and a sail between said booms. The position of the mast is controllable by the user and is free from pivotal restraint in the absence of such control.

While wind propelled vehicles of the type described by Schweitzer have gained popularity, they are often very difficult to control, especially with larger sails which are generally more desirable for obtaining greater speeds or in high wind conditions. This is especially true when the user lacks the strength to maintain control of the position of the sail in such conditions, leading the vehicle to capsize.

A need therefore exists to improve the ease of controlling the vehicle, especially with larger sails and/or in high wind conditions.

SUMMARY OF THE INVENTION

The present invention provides means for single mast, direct user controlled wind propulsion vehicles which makes control of the mast (and hence the position of the sail supported by it) substantially easier. This permits the control of a larger than normal sail especially in high wind conditions, thereby resulting in higher attainable speed. Alternatively, it allows easier handling (i.e. without as much physical exertion) of any given size sail and under any given wind conditions.

Wind propelled apparatus according to the present invention comprises a vehicle body support means adapted to support a user; a mast pivotally mounted directly to the vehicle body, the mast supporting a boom around said mast; and a sail therebetween wherein the position of the mast and sail which is controllable directly by the user via force exerted on the boom, is limited to two degrees of freedom, at any given point in time one being rotationally about the axis of the mast and the other being in a plane transverse to the surface of the body e.g. perpendicular to the plane of rotation.

BRIEF DESCRIPTION OF THE DRAWINGS

FIG. 1 is a perspective view of a wind propelled apparatus according to an embodiment of this invention obtained by modifying a catamaran having a mast, sail and boom.

FIG. 2 is a blown-up sectional view along line 2—2 of FIG. 1, of a joint useful for pivotally mounting the mast on the surface of the catamaran (or any alternative type vehicle base) such that movement of the mast is limited to rotation about the axis of the mast and pivotally in a plane perpendicular thereto, i.e. movement with only two degrees of freedom.

FIG. 3 is a side view of the mounting joint of FIG. 2.

DETAILED DESCRIPTION OF THE INVENTION

Figure 4:
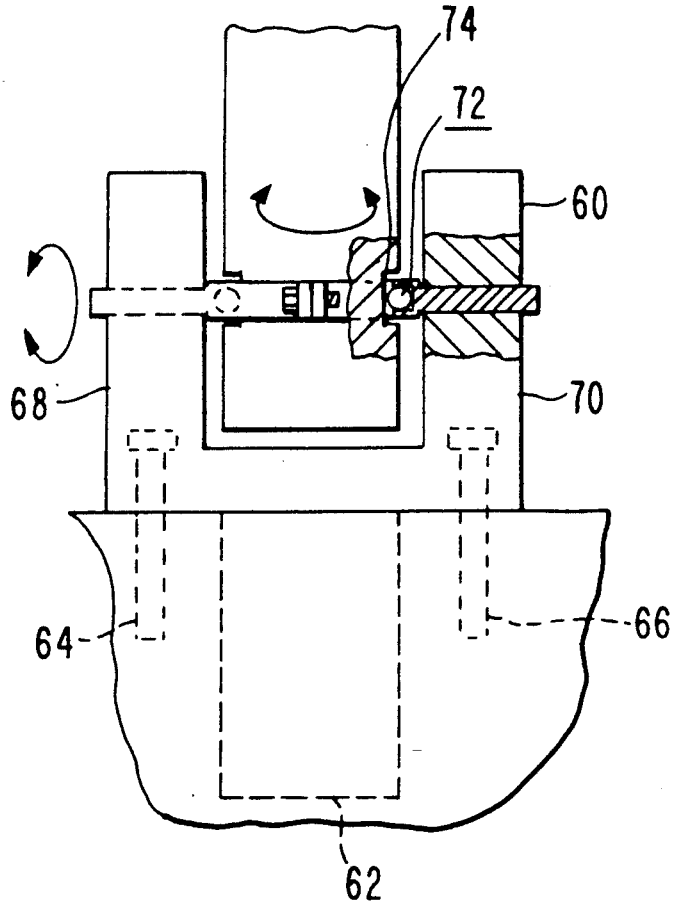
FIG. 4 is a perspective view of an alternative mast mounting means in accordance with the invention.

Referring to FIG. 1, a wind propelled apparatus is shown. The apparatus comprises a supporting member 10 such as a surfboard or catamaran, a mast 12 which extends upwardly from the supporting member 10, a pair of arcuate booms 14 and 16 respectively supported at one of their ends by the mast 12 several feet above the supporting member 10 and connected to each other at their other ends, and a sail 18 secured to the mast 12 and extending between and secured to the booms 14 and 16. As shown, the support member 10 is a catamaran which further includes a daggerboard 20, as leeboard, inserted through an opening in the central body portion 22 of the catamaran 10 and projecting obliquely from the bottom 24 thereof. Also shown are fins 25 for directional stability of the catamaran. The user of the apparatus stands on the support member 10 and controls the apparatus through movement and control of the booms 14 and 16 which he holds onto. Movement of the booms 14 and 16 translates to movement of the mast 10 and sail 18.

The mast 12 is typically a stout, rounded, elongated, preferably hollow shaft which preferably is of a strong lightweight material such as carbon fiber, fiberglass, plastic, boron compound fibers or composites thereof. It should be understood that the invention is not limited by the shape or composition of the mast 12, and, for example the mast may alternatively be solid as opposed to hollow and may be formed from more conventional materials such as wood or metal.

The present invention is characterized by the means 26 for mounting the mast 12 onto the support member 10 such that the movement of the mast is limited to two degrees of freedom at any given time. More particularly, the mast 12 is mounted so that it can rotate about its axis (one degree of freedom) and pivot about a single plane at any given time (the second degree of freedom), which plane is transverse to the plane of rotation. In accomplishing this objective, as will be shown hereinafter, in one embodiment e.g. is described with reference to FIG. 4, the mast mounting means 26 can be fixed with relation to the support member 10 such that the pivot plane which is transverse to (generally perpendicular to) the plane of rotation of the mast is fixed and is independent of the rotational position of the mast. In such a configuration, the pivot plane is preferably maintained so as to always be perpendicular the long axis of the support member, i.e. fore and aft. In the preferred configuration, the pivot plane varies and is dependent upon the rotational position of the mast. The first mentioned configuration increases the ease of handling by transmitting the forces exerted on the sail through the pivot joint instead of through the users arms as compared with the second and preferred configuration, while the second configuration allows for greater latitude in configuring the sail to obtain the greatest speed and maneuverability of the vessel as compared with the first configuration. However, both of the above configurations provide greater stability of the user and ease of handling of the vessel by the user, as compared with prior art vessels wherein the mast is mounted on a universal joint and unlimited in its direction of movement (i.e. the mast position has three degrees of freedom).

An example of a suitable mast support means 26 is shown in FIGS. 2 and 3. Here, the support means 26 comprises a lower cylindrical rotatable mounting shaft 28 which is rotatably mounted in a hole 30 provided in the support member 10. A ball bearing race 32 is provided around the lower portion of the shaft 28 to facilitate rotation of the shaft 28 in the hole 30. A nylon slip ring or bushing 34 and a spacer washer 36 are preferably provided around the upper portion of the shaft 28. The bushing 34 fits in the space between the shaft 28 and the hole 30 near the surface of the support member 10 and functions to keep water and debris from filling the space. The washer 36 which lies over the surface of the support member 10 provides separation between the surface of the support member 10 and a U-shaped member 38 secured to the shaft 28. The U-shaped member 38 may be secured to the shaft by any conventional means such as by screwing, welding, gluing, pinning or otherwise affixing it to the top portion of the shaft 28 which extends beyond the surface of the support member 10. In this configuration the U-shaped member 38 rotates with the shaft 28. The two side portions 40 and 42 of the U-shaped member 38 extend upwardly and are provided with opposing aligned holes 44 and 46, respectively, through which a retaining pin or shaft 48 may pass. The lower portion of the mast 12 is provided with a hole 50 of a size to accept passage of the retaining pin 48. The mast 12 is placed between the sides 40 and 42 of the U-shaped member 38 and affixed therebetween by means of the retaining pin 48 in a manner such that there is sufficient space 52 between the bottom of the mast 12 and the base of the U-shaped member 38 so as to allow the mast to pivot about the retaining pin 48 in a plane perpendicular to the plane of rotation of the mast. In this embodiment, the specific pivot plane with relation to the major axis of the catamaran is dependent upon the specific angle of rotation of the shaft 28 and mast 12 coupled thereto.

Referring to FIG. 4, an alternative mast mounting means is shown which limits the pivot plane to fore and aft. Here, a U-shaped member 60 having a mounting shaft 62 and mounting pins 64 and 66 is secured to the support member 10. In this embodiment the U-shaped member is fixedly mounted to the support member and is not free to rotate. The sides 68 and 70 of the U-shaped member 60 are provided with opposing aligned holes through which a split collar ball bearing or low friction bearing assembly 72 can be provided. The mast 12 is provided with a peripheral groove or channel 74 into which the bearing assembly 72 seats. This holds the mast 12 in place while providing rotational motion of the mast 12 around its axis and pivotal motion of the mast around the axis of the collar bearing assembly 72. If the axis of the collar is perpendicular to the axis of the support member 12 (i.e. the catamaran or surfboard), the plane of pivotal rotation will be parallel to the axis of the support member such that the mast can only pivot fore and aft, no matter what the direction of rotation of the mast.

As another alternative, one can provide a mast and mast mounting assembly which combines both features. In this way, a neophyte can start with a configuration which limits pivotal motion to a fixed plane and when becoming more proficient, can easily modify the assembly to provide pivotal motion in a plane that varies with the angle of rotation of the mast. This can readily be accomplished by providing a pair of securing pins 76 and 78, (shown as phantom lines in FIGS. 2 and 3). The shafts of which pass through holes 80 in the base of the U-shaped member and into corresponding aligning holes provided in the support member 10. If the mast is provided with both a peripheral channel as in FIG. 4 and a through-hole as in FIGS. 2 and 3, one can interchange the retaining pin as shown in FIGS. 2 and 3 for the collar assembly 72 shown in FIG. 4. Thus with the collar assembly 72 in place together with the securing pins 76 and 78 the craft functions as described with reference to FIG. 4. With the retaining pin in place and the securing pins 76 and 78 removed, the craft functions as described with reference to FIGS. 2 and 3.

It should be understood that the embodiments described herein are merely representative of the invention and are not meant to be limiting. Any embodiment wherein the mast is restricted to only two degrees of freedom, one rotational about its axis and one in a plane transverse to such rotation is meant to be included herein. For example, as a further embodiment, one may utilize an oarlock mounted to the support base in a bushing to accomplish the desired limitation.

What is claimed is:

1. A wind propelled vehicle comprising a vehicle body having support means adapted to support a human being; a mast rotatably and pivotally mounted to said vehicle body; a boom supported by said mast; and a sail supported by said mast and said boom such that movement of the boom by said human being causes movement of the mast and sail, said vehicle including mast mounting means characterized in that movement of the mast at any given moment in time is confined to two degrees of freedom, one being rotationally about the axis of the mast and the other being pivotally in single plane transverse to the axis of rotation of the mast, wherein said mass mounting means is secured to the vehicle body support means and comprises a bottom portion and two upwardly extending, opposing, spaced side portions between which said mast is pivotally mounted, said bottom portion including means for securing said mast mounting means to said vehicle body support means, said spaced side members having opposingly aligned holes therein, and means adapted to fit within said opposing holes for pivotally mounting said mast thereto, said mast adapted to receive such pivotal mounting means, said vehicle including a split ring collar secured to a circumferential groove provided around said mast for receiving said collar, said collar including opposing rod-like extensions which pass through the opposing holes in the side portions of said mast mounting means, said mast being rotatable within said collar and pivotal about the axis of said rod-like extensions.

2. The wind propelled vehicle recited in claim 1 wherein said mast mounting means includes a shaft extending downwardly from said bottom portion of said mast mounting means and said body vehicle support means having a hole therein adapted to receive said shaft.

3. The wind propelled vehicle recited in claim 2 wherein said shaft is rotatably mounted in said hole of said vehicle support means.

4. The wind propelled vehicle recited in claim 3 wherein said means for pivotally mounting said mast is a retaining rod which extends through said holes and through a hole provided in said mast for receiving said retaining rod, said rod being interchangeable with said split ring collar.

5. The wind propelled vehicle recited in claim 4 including means for preventing rotation around said shaft in said support means when said collar is substituted for said retaining rod.

6. The wind propelled vehicle recited in claim 3 including bearing means around said shaft for providing rotation thereof.

7. The wind propelled vehicle recited in claim 3 including a bushing in said hole in which said shaft lies and within which said shaft can rotate.

* * * * *